US005728000A

United States Patent [19]

Bateman

[11] Patent Number: 5,728,000

[45] Date of Patent: Mar. 17, 1998

[54] EAVE VENT

[76] Inventor: William Kevin Bateman, 1723 Wagon Gap Trail, Houston, Tex. 77090

[21] Appl. No.: 634,021

[22] Filed: Apr. 17, 1996

[51] Int. Cl.[6] ..... F24F 7/02

[52] U.S. Cl. ..... 454/260; 454/270; 454/280

[58] Field of Search ..... 454/260, 270, 454/280; 52/95

[56] References Cited

U.S. PATENT DOCUMENTS

| | | | |
|---|---|---|---|
| 3,051,071 | 4/1962 | Leigh | 454/260 |
| 4,607,566 | 8/1986 | Bottomore et al. | 98/37 |
| 4,660,463 | 4/1987 | Bottomore | 52/95 |
| 5,328,406 | 7/1994 | Morris, Jr. et al. | 454/260 |

FOREIGN PATENT DOCUMENTS

| | | | |
|---|---|---|---|
| 1073-258 | 3/1980 | Canada | 454/260 |

*Primary Examiner*—Henry Bennett
*Assistant Examiner*—Derek S. Boles
*Attorney, Agent, or Firm*—Michael B. Jolly

[57] ABSTRACT

A one-piece continuous roof drip edge vent comprising an upper planar section a middle louvered section and a lower section. The upper section extends up an inclined roof so that a starter row of shingles is not necessary, the lower section abuts the horizontal facia board and the middle section which is perpendicular to the lower section is continuously louvered to facilitate air inlet venting along the entire roof drip edge.

15 Claims, 5 Drawing Sheets

EAVE VENT

BACKGROUND OF THE INVENTION

This invention relates to roof ventilation systems and more particularly to a one-piece continuous inlet roof drip edge soffit vent. The vent is installed on the roof edge eliminating the need for an eave vent strip, eave vent plate, roof drip edge material, roof edge board, and a starter course of shingles.

Home builders, engineers, architects and scientist agree that roof ventilation is a necessity with today's energy efficient building practices. Properly ventilated roofs provide the essential year around functions of eliminating moisture condensation problems, reducing heat buildup during hot weather, and preventing ice dams during cold weather.

The main purpose of roof ventilation is to remove moisture from attic space air above the insulated interior living space. Both interior air moisture and external air moisture contribute to the total moisture content in attic space air. Sources of interior air moisture include slab moisture, washers, dryers, showers, dishwashers, and normal living processes of the inhabitants. Interior air moisture is increasingly contributing to attic space air moisture with the recent building trend of building tighter and more efficient living spaces. Consequently, interior air moisture, with the hotter air rises and permeates into the attic space above. The moisture, once in the attic space, will condense on a cooler roof deck underside and accurate to form water, frost, or ice. The water then drips on the insulation, attic rafters and ceiling building materials promoting premature deterioration, mold accumulation, insulation failure and sheetrock discoloration. A properly ventilated attic space will prevent these problems.

Numerous inlet attic ventilation systems have been proposed such as soffit vents, continuous louvered metal strips, gable vents, electrical powered vents, and continuous drip edge soffit starter vents. It is recognized that the most efficient way to ventilate a roof is with continuous ridge outlet vents and continuous inlet soffit vents.

All building codes now require some type of roof ventilation. Additionally, most codes require a minimum of 1 square foot of net free vent area (NFVA) for every 150 square feet of ceiling below the roof. NFVA is calculated as the total area of the vent opening taking into account any area blocked by screen mesh and/or louvers. Ideally, the total required ventilation is divided between inlet and outlet vents thus reducing the required inlet vent area to 1 square foot for every 300 square feet of ceiling. Maintaining the inlet vent to ceiling area ratio of 1:300 can be accomplished by the use of many types of soffit vents including perforated soffit material and separated soffit screens. Conventional soffit venting leads to large pockets of dead air space between the soffit vents. Continuous soffit venting may solve the problem of dead air space above the vents however, their use will not prevent ice damming. Ice damming occurs when snow above the upper portions of insulated attics melts and flows onto the colder roof edge where it freezes, expands under the shingles, and causes deterioration of roofing materials and trim. Ice damming can only be prevented if snow melts evenly over the roof surface including the roof edge, to accomplish this the roof must be vented at a location closest to the roof's edge.

Edge vents provide the proper placement of continuous inlet venting at the roof's edge to provide even distribution of venting thus preventing dead air spaces, moisture buildup, and ice-damming. Although prior edge vents have been developed they have lacked sufficient NFVA to provide the necessary 1:300 ratio. The prior developments have also lacked the structural integrity necessary to handle lateral loads associated with placing a ladder against the edge vent. The present invention provides a continuous roof edge vent with sufficient NFVA to provide a 1:300 ceiling area to vent area ratio, and the necessary structural integrity to handle lateral loads.

SUMMARY OF THE INVENTION

It is accordingly an object of the present invention to provide a one piece continuous roof edge vent supplying air-inlet ventilation continuous with the roof edge thereby maximizing air circulation in the roof space and minimizing dead air pockets and attic air moisture content.

It is a further object of the invention to provide a continuous roof drip edge vent with sufficient structural integrity so that the vent does not bend or collapse upon the normal lateral forces associated with placing a ladder against the roof's edge.

It is another object of the present invention to provide a continuous roof drip edge vent with net free vent area of at least 9.9 square inches per linear foot of drip edge vent material.

It is another object of the present invention to provide a continuous roof drip edge soffit vent which reduces attic air space moisture, dead air pockets, and roof ice damming.

DETAILED DESCRIPTION OF THE DRAWINGS

While the present invention will be described fully hereinafter with reference to the accompanying drawings, in which particular embodiments are shown, it is to be understood at the outset that persons skilled in the art may modify the invention herein described while still achieving the desired result of the invention. Accordingly, the description which follows is to be understood as a broad informative disclosure directed to persons of skill in the appropriate arts and not as limitations upon the present invention.

Figure 1:
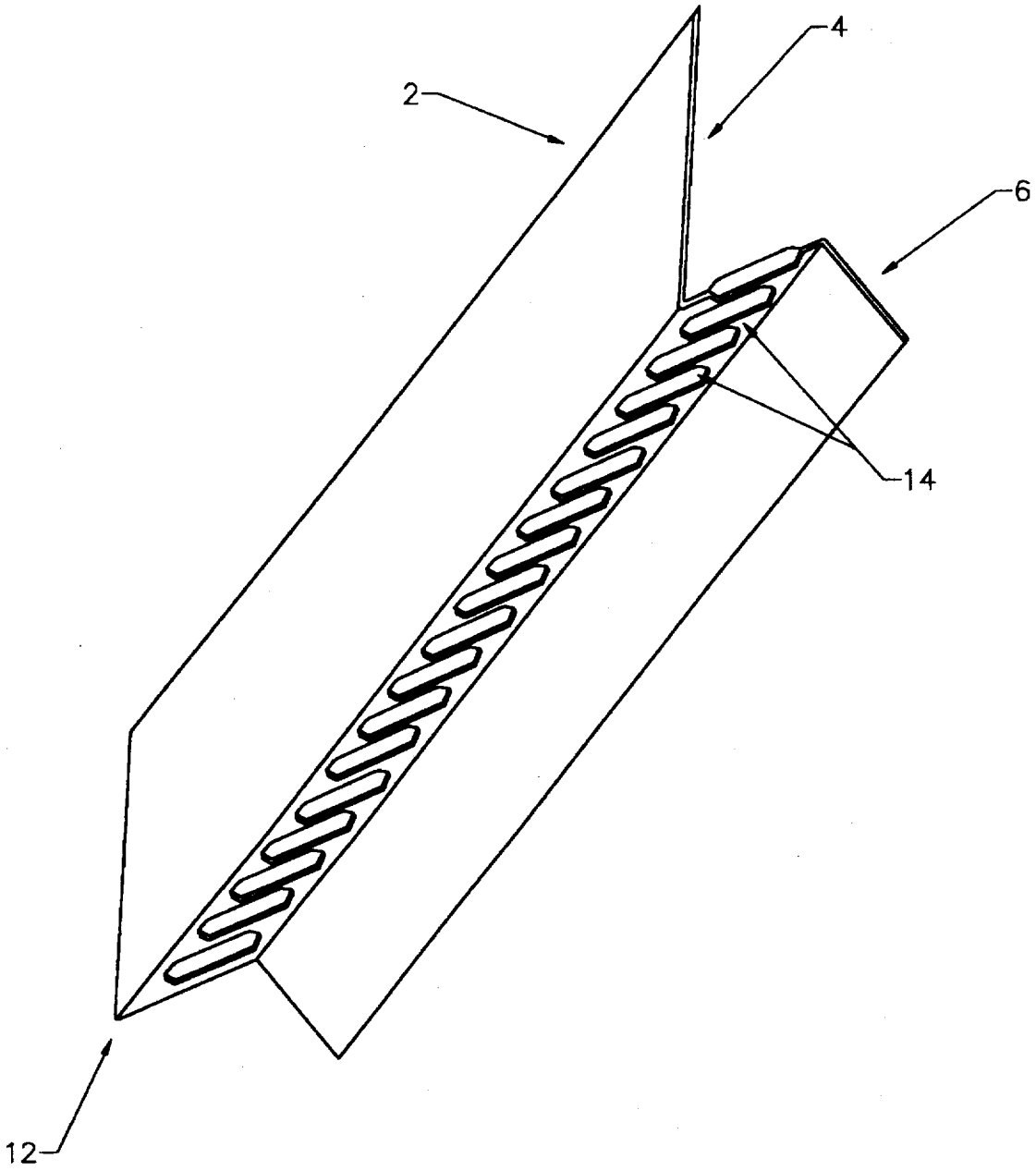
FIG. 1 is a front perspective view of the roof edge vent.
Figure 2:
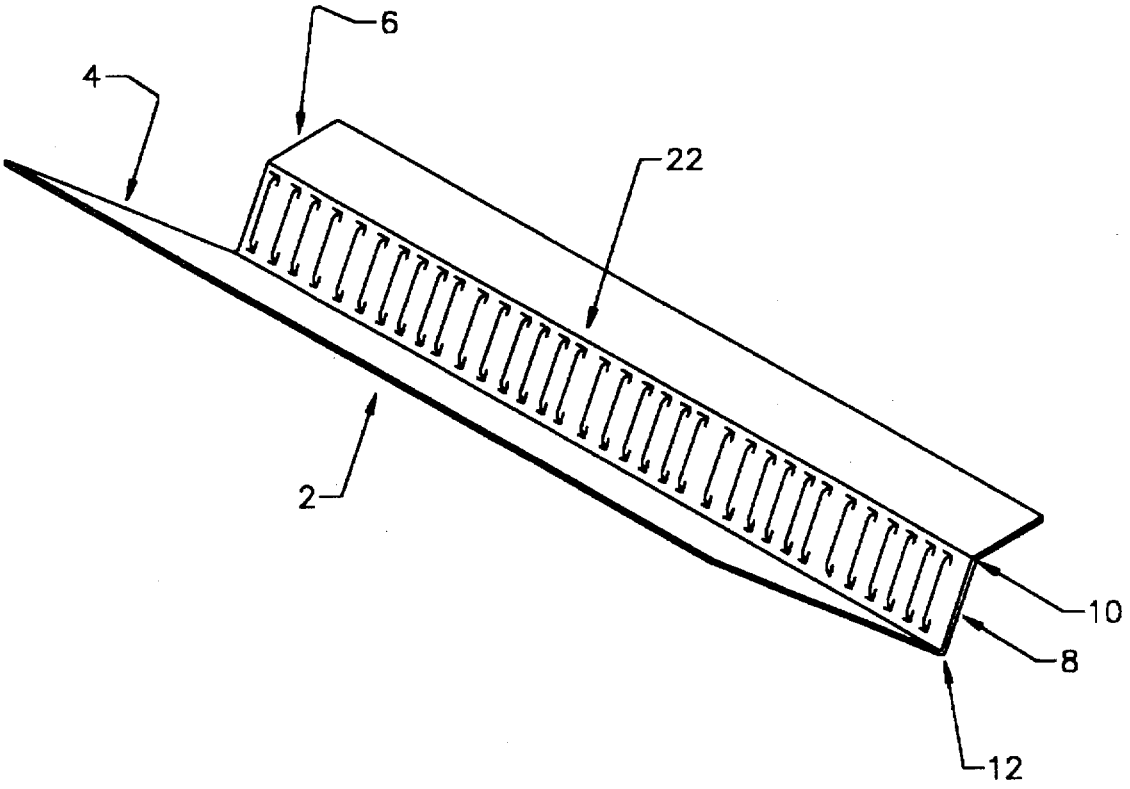
FIG. 2 is a back perspective view of the roof edge vent.
Figure 3:
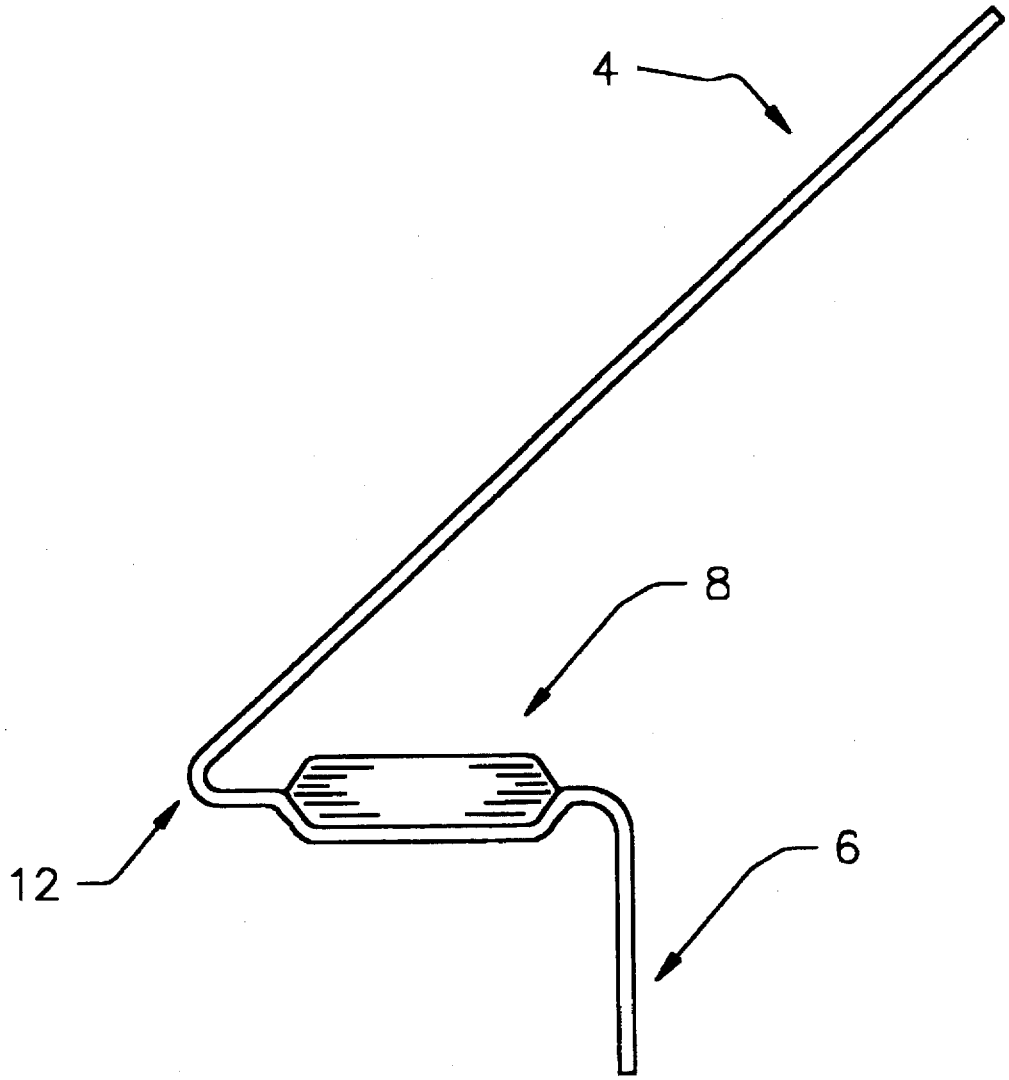
FIG. 3 is an end view of the roof edge vent.
Figure 4A:
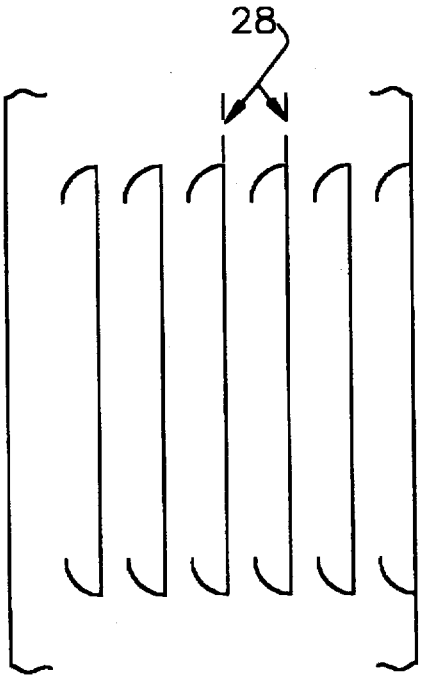
FIG. 4*a* is a sectional view of the louvers of the roof edge vent.
Figure 4B:
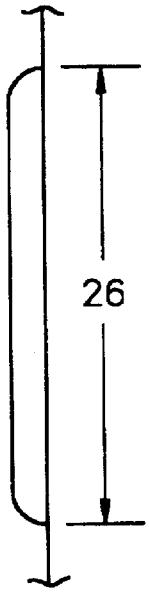
FIG. 4*b* is an individual louver of the roof edge.
Figure 4C:
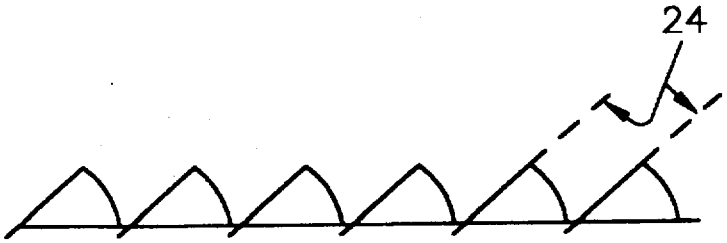
FIG. 4*c* is a cross sectional view of the louver section of the eave vent.
Figure 5:
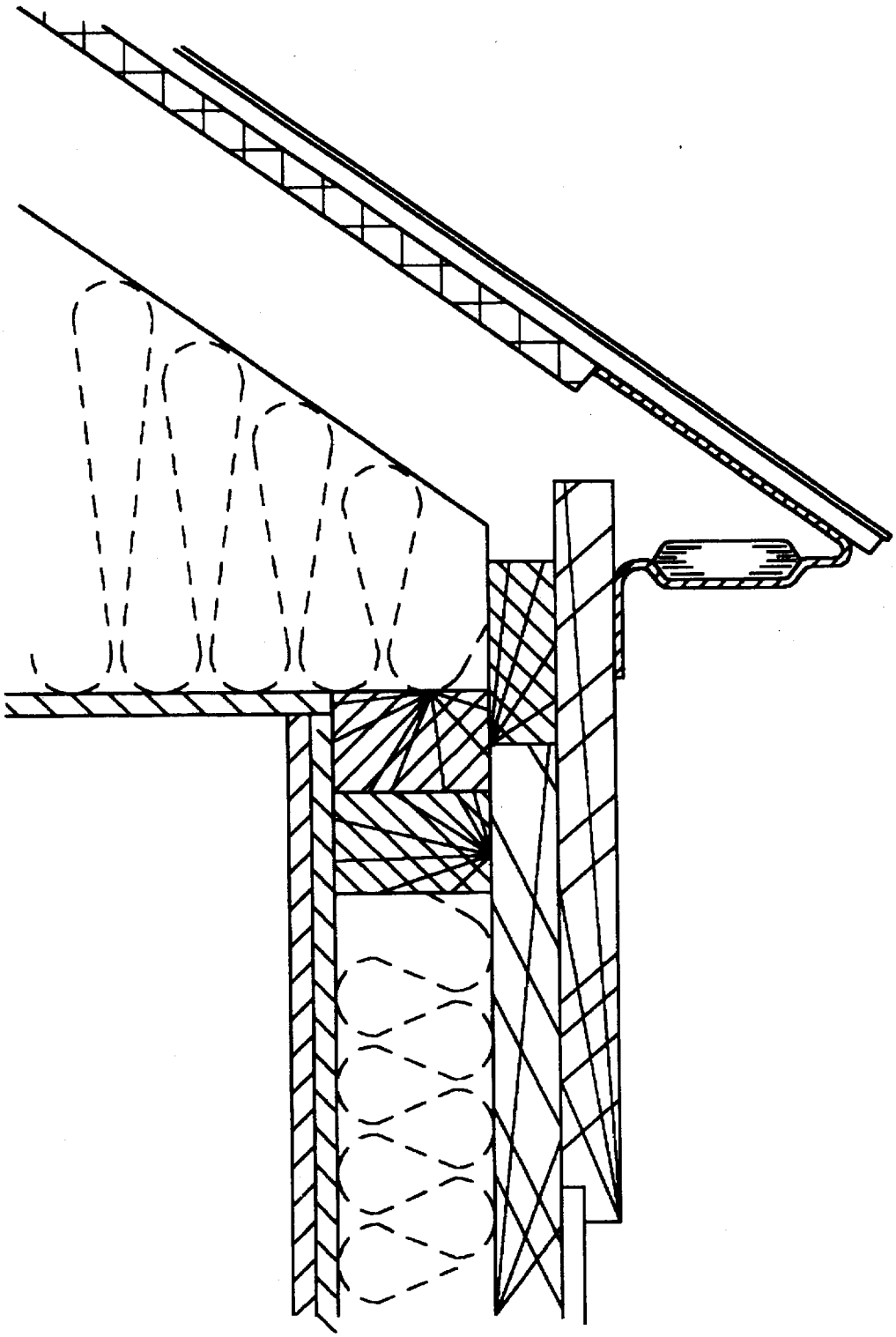
FIG. 5 is cross sectional view of a roof with the eave vent installed.

FIGS. 1 and 2 are perspective views of the continuous roof drip edge soffit vent 2. The vent 2 is constructed of elongated one piece material preferable eighteen gauge sheet aluminum or galvanized steel. The vent has an elongated upper panel 4 for disposition upon an inclined roof structure, a planar lower section 6 suitable for abutable attachment to a vertical wall structure, and a middle panel section 8 positioned between upper panel 4 and lower panel 6. Middle panel 8 is perpendicularly positioned to lower panel 6 and further connected to the lower panel 6 by bend 10. Middle panel 8 is also connected to the upper panel 4 by radial bend 12. Middle panel 8 is fitted with a multiplicity of slits 14 positioned parallel to one another and perpendicular to bends 10 and 12, further the length of said slits 14 extend from radial bend 12 to bend 10. The slits 14 form a multiplicity of louvers 16, said louvers 16 being positioned between each slit 14.

Upper panel 4 most preferably extends at least five inches from the radial bend 12 and as mentioned above the elongated upper panel 4 section is used to position the vent upon an inclined roof section 30 as illustrated in figure five. Providing an upper panel 4 with a length of at least five inches allows for the use of one row of starter shingles 34 and a means for securing the vent to the inclined roof section 30. Prior to the use of the present invention, common roofing practice was to apply two starter rows of shingles. This was necessary because shingles are supplied with slots and the slotted shingle openings must lay on top an alternatively positioned lower shingle. An economic advantage of the present invention, with the five inch upper panel 4, is that it dispenses with the need for two layers of starter shingles because the shingle slots open to the upper panel section, and further the upper panel 4 is about one inch longer than conventional shingle slots. The upper panel section 4 also functions as an attachment means for securing the vent to the inclined roof section 30. As nails are placed in the starter row of shingles, the nails permeate the upper panel section 4 and secure the vent in place. If the upper panel section 4 were not at least five inch long, then attaching the vent to the inclined roof section 30 with the starter row nails would not be possible.

Slit openings 20 are formed by rotational bending of the louvers 16 about an axis parallel to slits 14. The multiplicity of louvers 16 are bent in the same angle forming a continuous louvered middle panel section 22. It is most preferable to form the continuous louvered panel section 22 by use of either a die press or roll press.

Net free vent area (NFVA) is calculated by multiplying the measurement of the slit opening width 24, slit length 26 and number of slits per linear foot of vent material. The calculation is shown as follows:

X=slit opening width in inches.

Y=slit length in inches.

Z=number of slits per linear foot of vent material.

(X)(Y)(Z)=NFVA (square inches per linear foot)

Prior devices have NFVA well lower than the present invention. The preferably higher NFVA is accomplished by widening the slit opening width 24 by rotation of louvers 16 forty five degrees about an axis parallel to the slit openings 20. The preferred dimensions for slit opening 24 is 0.1268 inches, slit length 26 is 1.312 inches, and slit separation 28 is 0.200 inches. Additionally, this slit separation results in an average of 60 slit openings per linear foot of vent material. These dimensions provide a eave vent with 9.98 square inches of NFVA per linear foot of vent material thus allowing the ratio of 1:300 to be easily achieved.

Coupled with the need to provide sufficient NFVA is the need to provide an roof edge vent with sufficient structural integrity so that once the vent is mounted on the roof it has the ability to handle lateral loads associated with placing a ladder against the vent. Prior roof edge vents have experienced problems with crushing under the lateral forces associated with placing a ladder against the vent. Additionally, positioning the louvers parallel to the roof facia board 32 results in a roof edge vent which is crushed very easily when lateral loads are applied to the vent. The present invention utilizes louvers positioned perpendicularly to the roof facia board 32 which louver members function to strengthen the vent so that it may withstand lateral loads when installed. The inventor has found that the louvers must be positioned perpendicular to the roof facia board and if the louvers are positioned parallel to the facia board the vent with easily crush like an accordion when subjected to lateral forces. Prior venting devices suitable for application under a building eave have not contemplated lateral crushing problems because these products are not subjected to the lateral forces as the present invention which finds itself extending from the roof edge beyond all other building components.

The present invention overcomes the lateral crushing problems experienced by the prior art by the use of a radial bend 12. Prior devices utilized an angled bend between the upper panel sections 4 and middle section 8, these devices experienced crushing when a load was applied laterally to the roof. It has been found that a radial bend 12 functions to distributes lateral loads between the middle panel 8 and upper panel 4 thereby increasing the lateral load necessary to crush the vent. The radial bend 12 is most preferable formed about an one eighth inch radius and forming an angle of 40 to 60 degrees between the middle panel 8 and upper panel 4. It has been found that a radial bend 12 formed about an one eight inch radius is preferred because smaller radial bends are ineffective for distributing the load between the two panels and larger radial bends tend to not function as a drip edge and water consequently rolls back under the vent edge. The two angle choices correspond to varying roof pitches of 5/12 and 9/12 pitch roofs. Roofs with a pitch which does not match the product can be accommodated by bending the product to meet the roof line. The two angle choices, 40 and 60 degrees also overcomes a problem encountered with manufacturing one angle choice. It was found that bending the vent on the job site distorts the vent and leads to an unsightly finished roof because the vent does not lay flat on the roof. It was found that manufacturing two angle choices allowed for most roof pitches with minor bending adjustments to be made in the field resulting in a more desirable finished product.

I claim:

1. A one piece continuous roof drip edge vent for buildings having an inclined roof structure, vertical wall structures, and an opening beneath the roof structure and the vertical wall structure, the vent comprising:

a) an elongated one-piece planar panel including, an elongated upper panel section for disposition on the inclined roof structure, a planar lower section suited for abutable attachment to the vertical wall structure, a louvered middle panel section positioned between said upper and lower sections and further perpendicular to said lower section, a 90 degree bend connecting the lower panel section to the middle section, and an angled bend connecting the middle section to the upper section;

b) said louvered middle section including a plurality of juxtaposed slit openings extending perpendicularly between said bends forming louvers between the slits;

c) said louvers further being rotated uniformly along their longitudinal axis creating louver openings for passage of air flow;

d) and, further wherein said elongated upper panel section extends at least five inches from said angled bend connecting the middle and upper sections.

2. Apparatus as set forth in claim 1 wherein said angled bend is a radial bend formed about an eighth inch radius.

3. Apparatus as set forth in claim 1 wherein said angled bend connecting said upper and middle sections is 40 degrees.

4. Apparatus as set forth in claim 1 wherein said angled bend connecting said upper and middle sections is 60 degrees.

5. Apparatus as set forth in claim 1 wherein said louvered middle section extends one and three quarter inches between the 90 degree bend and the angled bend.

6. Apparatus as set forth in claim 1 wherein said louvers are uniformly bent by rotating the louvers at least 45 degrees around their longitudinal axes.

7. Apparatus as set forth in claim 1 wherein said louver slits openings extend 1.312 inches perpendicularly between the 90 degree bend and the angle bend.

8. Apparatus as set forth in claim 1 wherein said juxtaposed slits are 0.200 inches apart.

9. Apparatus as set forth in claim 1 wherein said louver openings formed by the rotation of the louvers is at least 0.130 inches wide.

10. Apparatus as set forth in claim 1 wherein said angled bend between said middle and upper sections includes a radial bend.

11. Apparatus as set forth in claim 1 wherein said louvers formed amount to at least 60 louvers per linear foot of vent material.

12. A one piece continuous roof drip edge for buildings having an inclined roof structure, vertical wall structure, and an opening beneath the roof structure and the vertical wall structure, the vent comprising:

a.) an elongated one-piece planar panel including, an elongated upper panel section for disposition on the inclined roof structure, a planar lower section suited for abutable attachment to the vertical wall structure, a louvered middle panel section positioned between said upper and lower sections and further perpendicular to said lower section, a 90 degree bend connecting the lower panel section to the middle section, and a radial bend with a radius of one eighth inch connecting the middle section to the upper section;

b.) said louvered middle section including a plurality of juxtaposed slit openings extending perpendicular between said bends forming louvers between the slits;

c.) said louvers further being rotated uniformly along their longitudinal axis creating louver openings for passage of air flow;

d.) and, wherein said elongated upper panel section extends at least five inches from said angled bend connecting the middle and upper sections.

13. Apparatus as set forth in claim 12 wherein said radial bend is 40 degrees.

14. Apparatus as set forth in claim 12 wherein said radial bend is 60 degrees.

15. Apparatus as set forth in claim 12 wherein said juxtaposed slit openings includes an average of 60 slit openings per linear foot of vent material and further said slit openings extending 1.312 inches between the bends and further said formed louvered openings being 0.1268 inches from louver to louver.

* * * * *